United States Patent [19]

Yamaura et al.

[11] Patent Number: 4,679,990

[45] Date of Patent: Jul. 14, 1987

[54] ELECTRIC BLOWER

[75] Inventors: Izumi Yamaura, Toyonaka; Masami Fukumoto, Ikeda; Masao Torigoe, Itami, all of Japan

[73] Assignee: Matsushita Electric Industrial Co., Ltd., Osaka, Japan

[21] Appl. No.: 808,030

[22] Filed: Dec. 12, 1985

[30] Foreign Application Priority Data

| | | | |
|---|---|---|---|
| Dec. 28, 1984 | [JP] | Japan | 59-280375 |
| Dec. 28, 1984 | [JP] | Japan | 59-280376 |
| Dec. 28, 1984 | [JP] | Japan | 59-280409 |

[51] Int. Cl.[4] ..... F04D 29/66; F04B 17/00

[52] U.S. Cl. ..... 417/312; 415/119; 415/210; 417/366

[58] Field of Search ..... 415/119, 115, 116, 207-211; 417/423 A, 312, 366; 310/48, 52

[56] References Cited

U.S. PATENT DOCUMENTS

| | | | |
|---|---|---|---|
| 2,171,341 | 8/1939 | McMahan | 415/119 |
| 4,057,370 | 11/1977 | Numata et al. | 417/366 |
| 4,111,615 | 9/1978 | Watanabe | 417/423 A |

FOREIGN PATENT DOCUMENTS

| | | | |
|---|---|---|---|
| 1351721 | 4/1963 | France . | |
| 54-105306 | 8/1979 | Japan | 415/211 |
| 54-105307 | 8/1979 | Japan | 415/211 |
| 55-69797 | 5/1980 | Japan | 417/366 |
| 55-146299 | 11/1980 | Japan | 415/119 |
| 57-212399 | 12/1982 | Japan | 415/211 |
| 59-211798 | 11/1984 | Japan | 415/211 |
| 745059 | 1/1956 | Switzerland . | |
| 564918 | 6/1944 | United Kingdom . | |

OTHER PUBLICATIONS

Soviet Inventions Illustrated, Derwent Publications Ltd., Week 8518, Abstract No. SU 1118-806-A, Issued 12 Jun. 1985, & SU -A No. 433 634 (Nikolaev Ship Cons.) 15-10-1984.

*Primary Examiner*—Robert E. Garrett
*Assistant Examiner*—Joseph M. Pitko
*Attorney, Agent, or Firm*—Stevens, Davis, Miller & Mosher

[57] ABSTRACT

The electric blower comprises an impeller of the centrifugal type driven by a motor, a diffuser having a plurality of divergent passages into which air flow discharged from said impeller flows, an air guide having a return passage subsequently directing said air flow from said divergent passages into the interior of said motor, and a casing housing therein said impeller, said diffuser and said air guide. Each guide wall of said air guide defining said return passage includes an inner guide wall section, an outer guide wall section and a space interposed between each inner guide wall section and the corresponding outer guide wall section, an opening being formed at the inner terminal end of each space.

6 Claims, 13 Drawing Figures

ELECTRIC BLOWER

BACKGROUND OF THE INVENTION

The present invention relates to an electric blower suitable for use in a vacuum cleaner.

A prior art electric blower of the type described above has been so constructed that, as shown in FIG. 13, an impeller 2 and an air guide 3 are provided in a casing 1, and the impeller 2 is rotated at a high speed by a motor 4 to thereby provide a required air flow rate as well as a vacuum pressure.

In such an electric blower as described above wherein the air guide 3 is disposed around the outer periphery of the impeller 2, problem of noise arises which is thought to be generated due to the fact that the air flow discharged from the impeller 2 impinges against the inlet of the air guide 3, when it flows into the air guide. The most significant factor for generating the noise is in the range of frequences of sound resulting from the product of the number Z of blades and the number N of rotations of the impeller 2, which are referred to in general as NZ sound, FIG. 12 shows the NZ sound.

SUMMARY OF THE INVENTION

It is an object of the present invention to solve the problem of NZ sound. An electric blower according to the present invention is so constructed that sound arresting effect is achieved by a return passage itself of an air guide in the blower.

The technical measure employed by the present invention for solving the above problem of noise is to provide guide walls forming the return passage of the air guide by inner and outer guide wall sections, while a space having an open end or an opening at the inner terminal end thereof is formed between the inner and outer guide wall sections.

The above technical measure functions as follows:

The space formed by the inner guide wall section and the outer guide wall section constitutes a sound arrester, wherein the opening at the inner terminal end forms an inlet to thereby serve as a side branch in an acoustic circuit, so that the noise generated at the impeller and the inlet of the air guide is prevented from being transmitted outside. As a result, an electric blower is provided in which noise level is made low.

DETAILED DESCRIPTION OF THE PREFERRED EMBODIMENTS

Embodiments of the present invention will be described below referring to FIG. 1 to FIG. 12 of the accompanying drawings.

Figure 2:
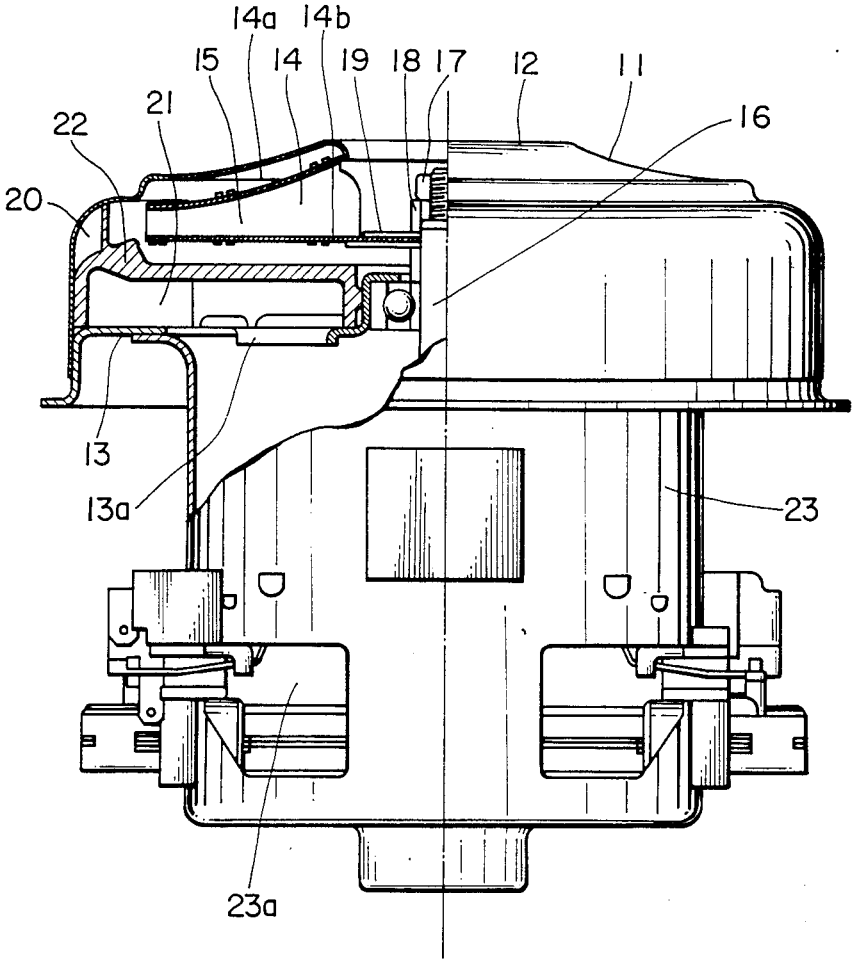
FIG. 2 is a fragmentary cross-sectional view of the electric blower.
Figure 3:
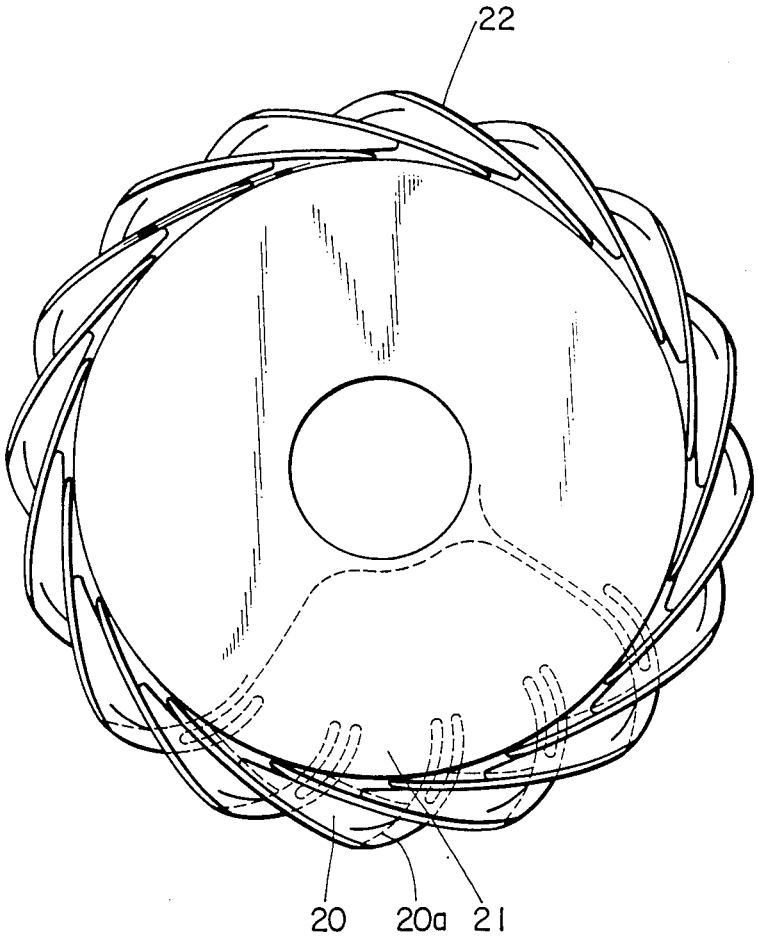
FIG. 3 is a plan view showing the air guide as viewed from the side of the diffuser thereof.
Figure 4:
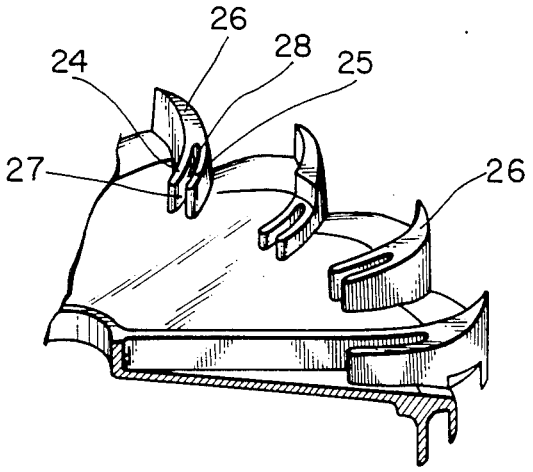
FIG. 4 is a fragmentary perspective view in an enlarged scale showing the return passage.

In FIG. 2, a casing 11 has a suction opening 12 formed therein at the center thereof. The side of the casing 11 opposite to the suction opening 12 is airtightly mounted on the outer periphery of a motor frame 13. An impeller 14 has a plurality of blades 15 (the number being Z) disposed between the upper and lower plates **14*a*, 14*b*, and the impeller is mounted on a motor shaft 16 by a nut 17 with a spacer 18 and a washer 19 interposed therebetween. An air guide 22 is disposed around the outer periphery of the impeller 14. The air guide 22 comprises a diffuser 20 including a plurality of diverging passages 20*a* and a return passage 21 communicating with each of the diverging passages 20*a* integrally formed therein. The return passage 21 communicates with a suction opening 13*a* formed in the motor frame 13. A motor 23 has a discharge opening 23*a*** formed at the lower part of the side thereof.

The main dimensions of the above components are set such that the outer diameter of the impeller 14 is 101 mm and the outer diameter of the air guide 22 is 124.5 mm.

Figure 1:
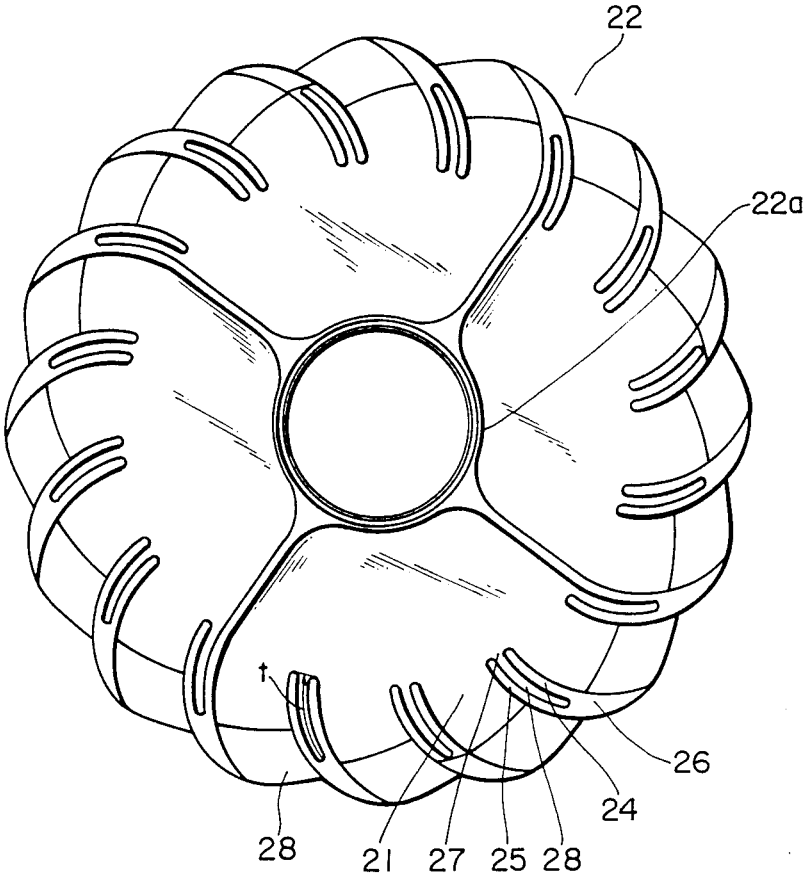
FIG. 1 is a plan view of a return passage of an air guide in an electric blower according to an embodiment of the present invention.

As shown in FIG. 1, the return passage 21 comprises guide walls 26 each consisting of an inner guide wall section 24 and an outer guide wall section 25 with the starting point of each guide wall 26 positioned adjacent to the outer periphery of the air guide 22. A space 28 having an open end or an opening 27 at the inner terminal portion thereof is formed between each of the inner guide wall section 24 and the corresponding outer guide wall section 25. Some of the inner guide wall sections 24 (four inner guide wall sections 24 in the illustrated embodiment which are equally spaced from each other) are connected to a central annular portion (**22*a*) of the air guide 22**.

The operation of the above described embodiment will be described below.

In FIG. 2, the air flow discharged from the impeller 14 flows through the diffuser 20 and enters the return passage 21 and flows into the motor 23 from the suction opening **13*a* to thereby cool the same, and then is discharged from the discharge opening 23*a*. Noise components represented by the NZ sound (N is the number of rotations, Z being the number of blades) are contained in the air flow flowing through the diffuser 20**.

Figure 5:
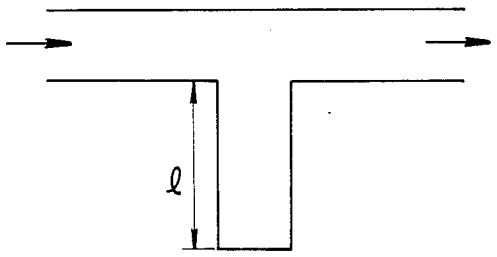
FIG. 5 is a diagram showing the function of the return passage.

The configuration of each of the spaces 28 formed by the inner guide wall section 24 and the corresponding outer guide wall section 25, respectively, is of a shape as shown in FIG. 5, when considered as a simplified system. This forms a side branch in an acoustic circuit and serves as a sound arrester.

The length l of the side branch corresponds to the length t of the space 28, and the value of l is said to be effective for arresting the sound of frequency fn' which may be represented by the following equation:

$$fn' = ((2n' - 1)/4)c/l$$

(c=acoustic velocity, n': 1,2,3, . . . ).

In the present embodiment, the number of rotations N of the impeller 14 is set to be 28,200 rpm and the number Z of the blades is set to be nine. Thus, the NZ sound is at a frequency near 4,230 Hz obtained from the following calculation.

$$(28{,}200/60)9 = 4{,}230$$

The value of is in the order of about 20 mm derived by the calculation. In this embodiment, however, the configuration is not so simple as that of the above described simplified system. As the result of experiments, the value t within the following range has been found to be effective.

$$0.7 \leqq t \leqq 1.3$$

From the above value, the value t in the present embodiment is set as t=14 mm.

Figure 11:
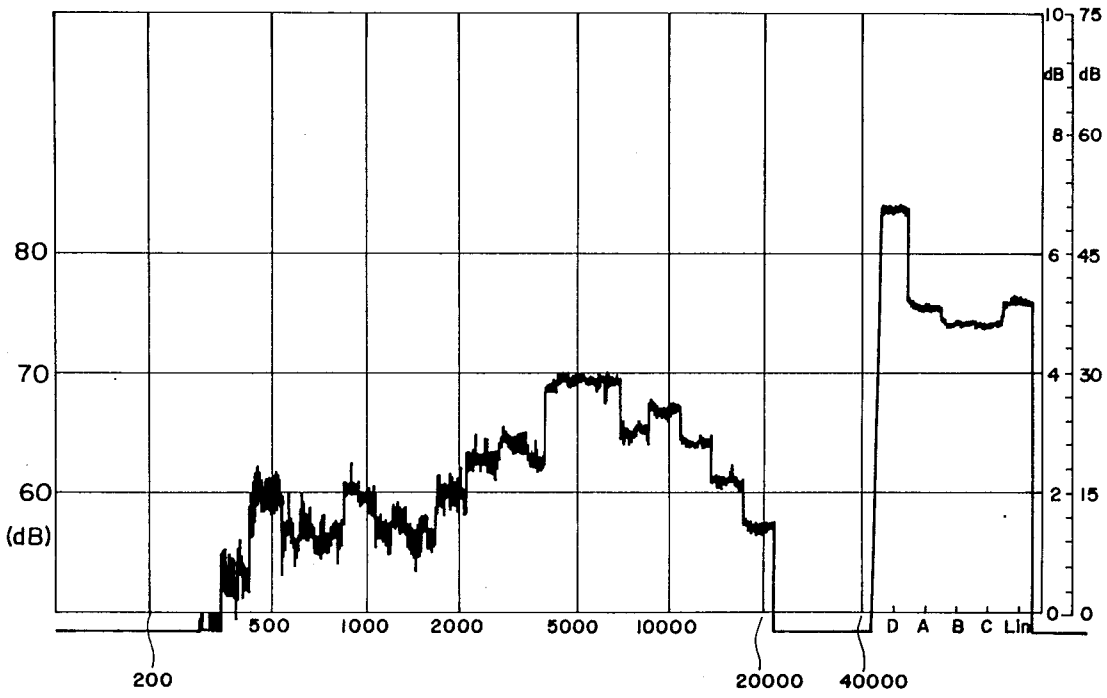
FIG. 11 is a diagram showing the analysis of frequencies, showing the effects of the present invention.
Figure 12:
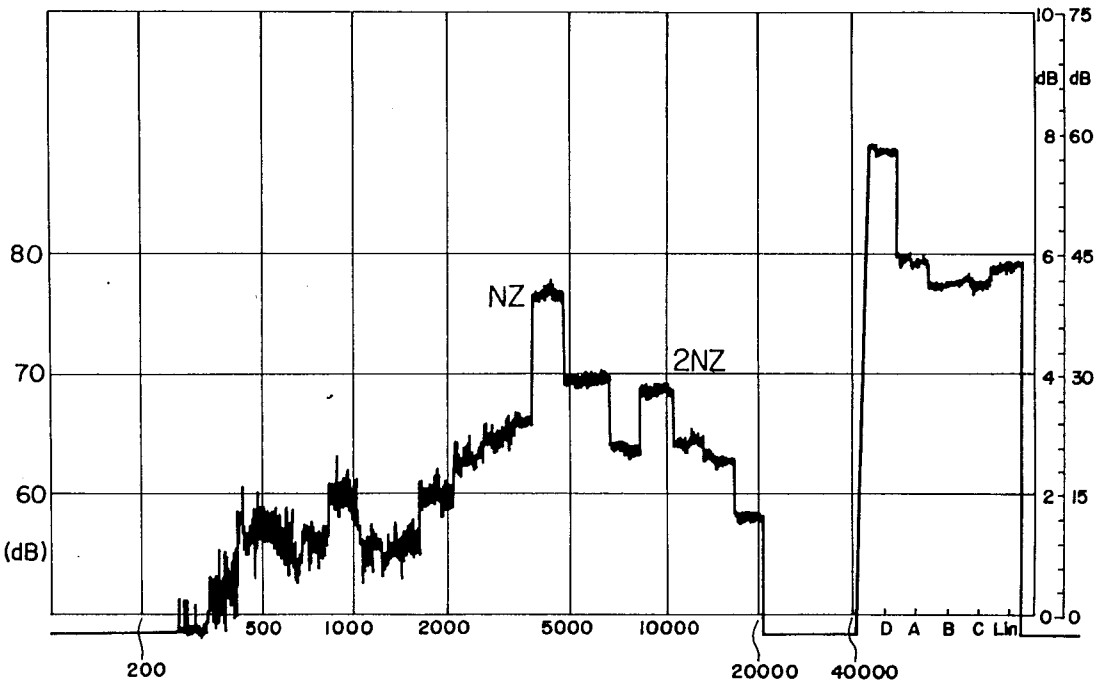
FIG. 12 is a diagram showing the analysis of the prior art.
Figure 13:
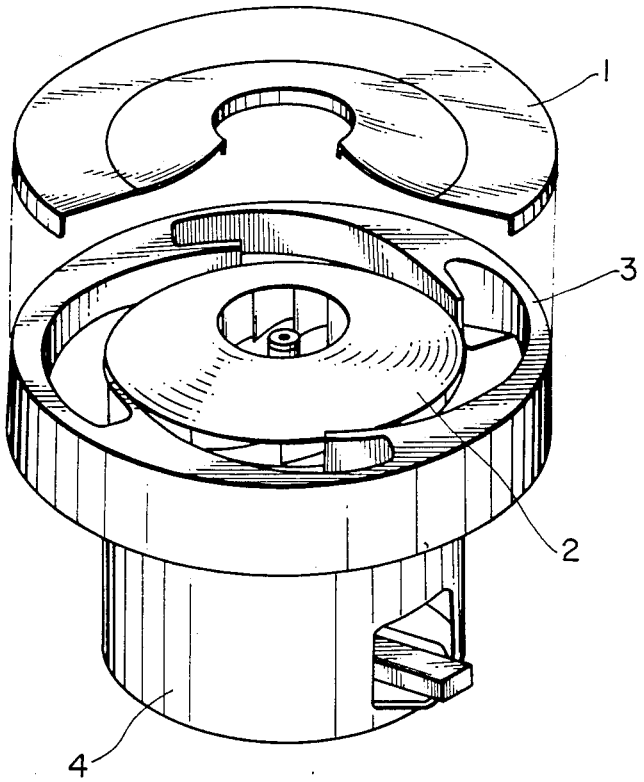
FIG. 13 PRIOR ART
FIG. 13 is an exploded perspective view showing a prior art electric blower.

The air flow containing the noise components enters the return passage 21 from the diffuser 20 and, thus, the NZ sound is substantially arrested by virtue of the effect of the above described side branch formed by the space 28 to thereby render the air flow to be a silent air flow. This condition is shown in FIG. 11. Thus, a remarkable sound arresting effect can be achieved in comparison with that of the prior art shown in FIG. 12 (78 dB of the NZ sound is reduced to 69 dB).

Another embodiment of the present invention will be described below. The radi R(i), R(o) of curvature of the curved inner guide wall section 24 and the curved outer guide wall section 25 shown in FIG. 6, respectively, are set to have the relationship:

$$R(i) > R(o).$$

The effect obtained from the above construction is as follows. The air flow entering the return passage 21 from the diffuser 20 has its flow direction deflected so that it is rendered a uniform flow within the entire return passage 21. At this time, the portion of the air flow flowing adjacent to the inner guide wall section 24 which is the outer side portion of the air flow is under a concentrated condition, and the portion of the air flow flowing adjacent to the outer guide wall section 25 is at the inside of the above described connected portion of the flow along the inner guide wall section 24, and it is under the condition tending to cause separation 29 having a smaller radius of curvature than R(i) of the inner guide wall section 24. In the present embodiment, since the radius of curvature R(i) of the inner guide wall section 24 along which the outside portion of the air flow flows is set to be large, the flow along the inner guide wall section 24 can be smoothly deflected. On the other hand, since the radius of curvature R(o) of the outer guide wall section 25 along which the inside portion of the flow flows is set to be small, it functions to compensate for the separation 29. Therefore, the entire air flow tends to flow along the guide wall 26, and the flow tends to flow adjacent to the opening 27 of the space 28 to thereby insure the sound arresting effect, while the entire flow is rendered smooth thereby enhancing the blasting or flow efficiency.

Figure 6:
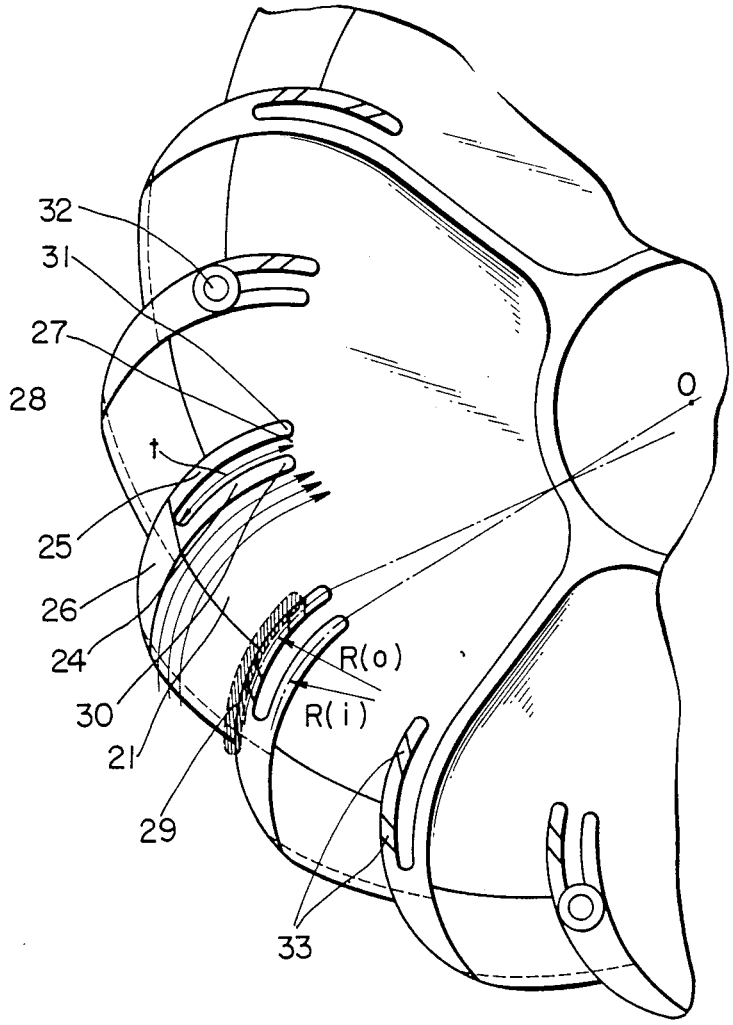
FIG. 6 is a fragmentary perspective view in an enlarged scale showing the return passage.

Another embodiment will be described below. In FIG. 6, the terminal end 30 of the inner guide wall section 24 in the guide wall 26 consisting of the inner guide wall section 24 and the outer guide wall section 25 at the side of the center of the air guide 22 is oriented in the direction substantially toward the center O of the air guide 22, while the terminal end 31 of the outer guide wall section 25 is directed to a direction to intersect a point intermediate the length of the line connecting the terminal end 30 of the inner guide wall section 24 and a point substantially coinciding with the center O of the air guide 22. With the construction described above, the following effect is obtained.

The air flow discharged from the impeller 14 tends to be directed toward the circumferential direction of the air guide 22, but the direction of the air flow is deflected by the return passage 21. At this time, if the terminal end 30 of the inner guide wall section 24 at the side of the center of the air guide 22 is oriented substantially toward the circumferential direction of the air flow in the same direction as that of the flow, then the flow will cause a circulating flow circuit circulating adjacent to the center of the air guide 22. On the other hand, if it is oriented substantially toward the circumferential direction of the air flow in the reverse direction to that of the flow, then the flow will be subjected to a great deviation of direction. Both of these deviations will cause substantial loss in the flow. In the present embodiment, since the terminal end 30 is directed substantially toward the center O of the air guide 22, there is no loss as described above and the portion of the air flow flowing along the inner guide wall section 24 is directed as a whole toward the center, while the portion of the flow flowing along the outer guide wall section 25 is directed toward a point near the center of the opening 27 to thereby insure the positive sound arresting effect obtained by the space 28.

Figure 7:
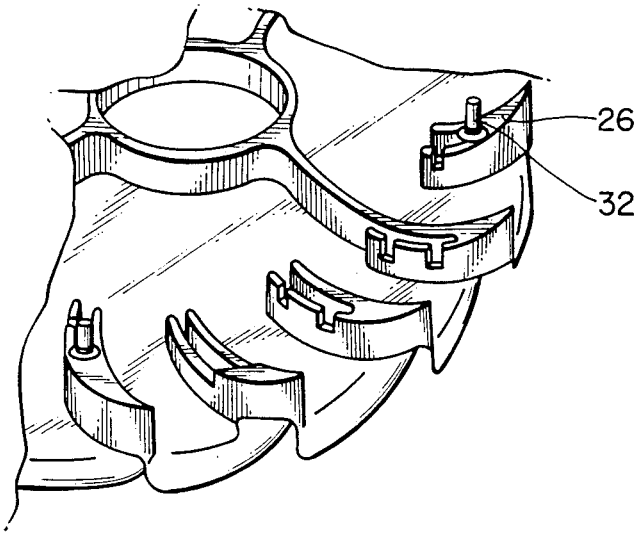
FIG. 7 is a fragmentary perspective view in an enlarged scale showing a portion of the return passage adjacent to a mounting pin mounted on the return passage.

A further embodiment will be described below. The reference numeral 32 in FIGS. 6–8 designates a mounting pin for securing and positioning the air guide 22 with respect to the motor frame 13. The mounting pin 32 is of a configuration having a projection adapted to fit in a hole formed beforehand in the motor frame 13. The mounting pin 32 is integrally secured to a portion between the previously described inner guide wall section 24 and the corresponding outer guide wall section 25 in the guide wall 26. FIG. 7 is a perspective view of the mounting pin 32.

The effect obtained by the above construction is as follows. First, the effect can be varied by the fact that the mounting pin 32 is secured in the area between the inner and outer guide wall sections 24, 25. In other words, when the mounting pin 32 is secured adjacent to the opening 27 at the inner terminal end of the inner and outer guide wall sections 24, 25, the length t of the space 28 can be made short. To the contrary, when the point in the guide wall 26 at which the mounting pin 32 is secured is shifted toward the outer periphery of the air guide 22, the length t of the space 28 can be made large. As a result, noise can be lowered, which noise has frequencies different from those of noise which are generated under the condition no mounting pins 32 are provided in the guide wall 26 having a space 28 of the length t between the inner and outer guide wall sections 24, 25 under the condition of the length t of the space 28. In the present embodiment, the mounting pins 32 are provided in four guide walls equally spaced from each other among the sixteen guide walls and the length t of each space 28 in the above four guide walls provided with the mounting pins 32 is set to be about a half of that of other spaces. Thus, sound arresting effect of high frequencies such as 2 NZ sound which is the high frequency of the NZ sound (FIGS. 11 and 12) can be achieved.

Figure 8:
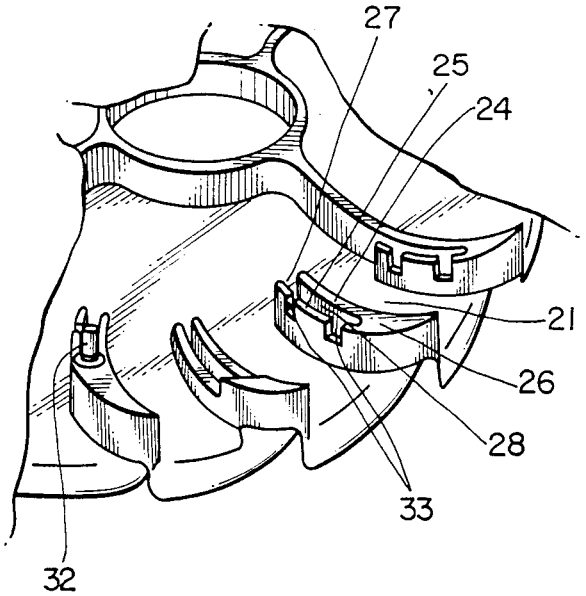
FIG. 8 is a fragmentary perspective view in an enlarged scale showing a portion of the return passage adjacent to a communicating portion formed in the return passage.

A still further embodiment will be described below. In FIGS. 6–8, the reference numeral 33 designates groove-like communicating passages. These communicating passages 33 have a width of the order of 1 mm and the depth of the order of 4 mm, and two passages 33 are formed in each outer guide wall section 25. The communicating passages 33 are formed slantwise toward the downstream side of the return passage 21. Other configuration of the communicating passage 33 than the groove-like form, i.e., a circular hole, for example, may be adopted.

Figure 9:
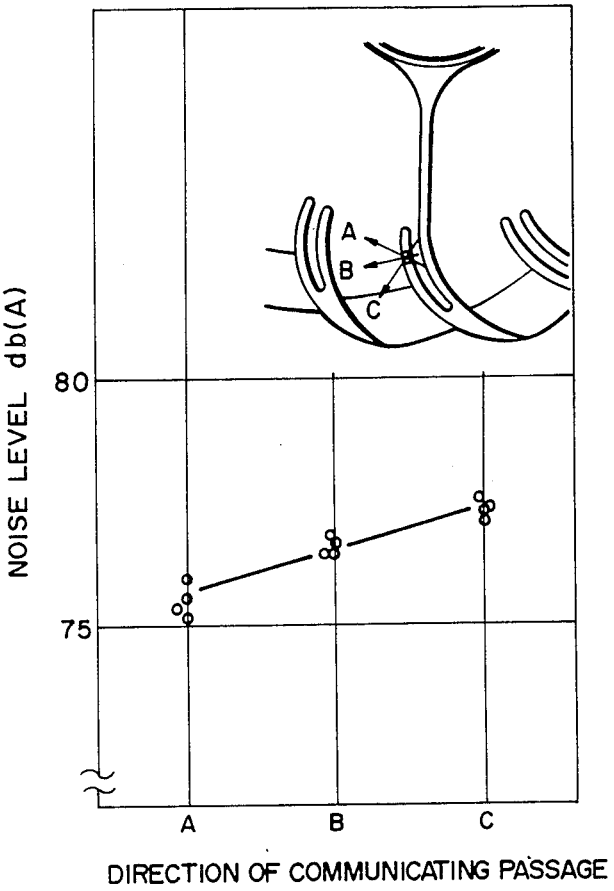
FIG. 9 is a diagram showing the effects of the present invention.
Figure 10:
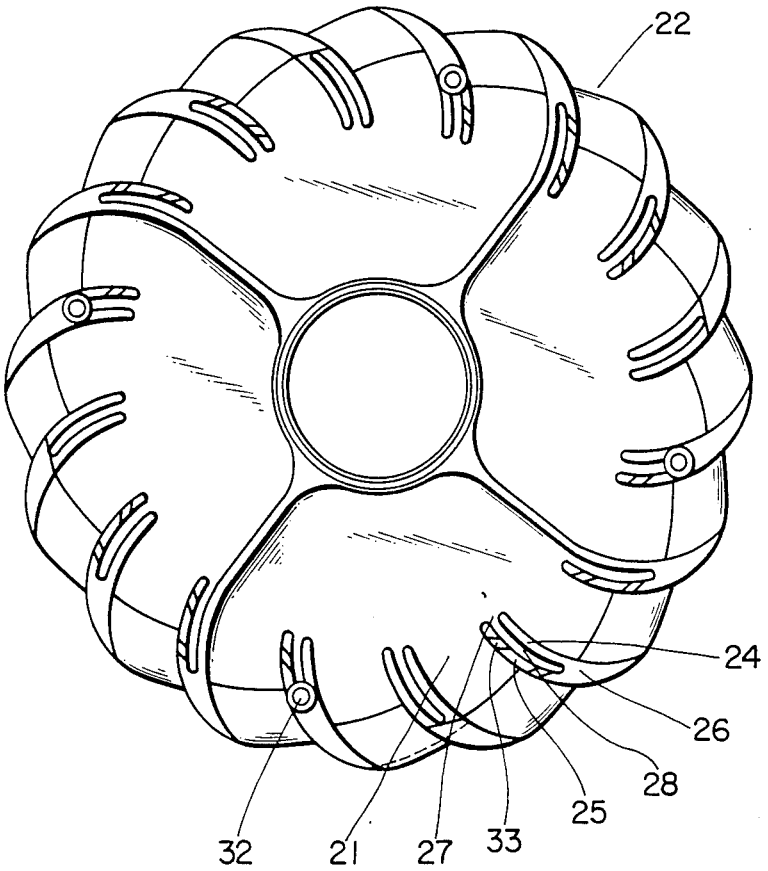
FIG. 10 is a plan view of a return passage of an air guide, showing the entire embodiments of the present invention.

The effect obtained by the above construction is as follows. It has been previously described that a construction where no communicating passages 33 are provided can be replaced by a simplified system as shown in FIG. 5, i.e., a side branch serving as a sound arrester in an acoustic circuit. The length t of the space 28 is made to be a length corresponding to the frequencies desired to be arrested. In summary, the above communicating passage 33 serves as means for varying the length t of the space 28, wherein a plurality of sound arresters are formed having inlets of side branches at the communicating passages 33, respectively. Thus, an effect is obtained that noise of especially high frequencies can be simultaneously arrested or reduced. FIG. 9 shows the results of observations wherein the directions of inclination of each communicating passage 33 from the space 28 toward the return passage 21 are varied (A, B, C). When the direction of inclination is further deflected toward the downstream side of this figure, i.e., toward the direction A, it is proved that the effect for reducing noise is increased. Therefore, in the present embodiment, the communicating passages 33 are set to have the orientation inclined toward the downstream side. A similar effect is obtained when the communicating passages 33 are formed in the inner guide wall sections 24. The number of the communicating passages 33 may be selected appropriately depending upon the frequencies which are desired to be arrested.

As to the function of the communicating passages 33, an effect is obtained to prevent separation of air flow from the guide wall 26 by the fact that air is supplied thereto through the communicating passages 33, when the air flow tends to be stripped from the guide wall 26.

According to the present invention as described above, frequencies which might cause severe problems in an electric blower can be positively reduced. As to the construction of the present invention, it suffices to merely apply some measures to the guide walls forming the return passages and such measures will not affect the efficiency of the blower.

What is claimed is:

1. An electric blower comprising an impeller of the centrifugal type driven by a motor, an air guide having a diffuser including a plurality of divergent passages into which air flow discharged from said impeller flows and a return passage subsequently directing the air flow from said divergent passages into the interior of said motor, a casing having therein said impeller and said air guide, a guide wall forming said return passage comprising inner guide wall sections, outer guide wall sections and spaces interposed between each inner guide wall section and the corresponding outer guide wall section, an opening being formed at the inner terminal end of each of said spaces, the terminal end of each inner guide wall section at the side of the center of said air guide being set to be directed substantially toward the center of said air guide, the terminal end of each outer guide wall section at the side of said air guide being set to be directed to a point intermediate the length of a line connecting said terminal end of said inner guide wall section and the center of said air guide.

2. An electric blower according to claim 1, wherein the radius of curvature (R(o)) of each outer guide wall section and the radius of curvature (R(i)) of each inner guide wall section in said curved guide wall are set to have the relationship $R(o)<R(i)$.

3. An electric blower comprising an impeller of the centrifugal type driven by a motor, an air guide having a diffuser including a plurality of divergent passages into which air flow discharged from said impeller flows and a return passage subsequently directing the air flow from said divergent passages into the interior of said motor, a casing having therein said impeller and said air guide, a guide wall forming said return passage comprising inner guide wall sections, outer guide wall sections and spaces interposed between each inner guide wall section and the corresponding outer guide wall section, an opening being formed at the inner terminal end of each of said spaces, and, a mounting pin provided at a point in the area adjacent between an inner guide wall section and a corresponding outer guide wall section of some of said guide walls, each of said mounting pins having a projecting portion adapted to enter a frame of said motor, the position of each mounting pin being set to be adjacent to a termination of the space associated therewith, said associated space having a length about a half of the length of a space in each guide wall which is not provided with said mounting pin.

4. An electric blower according to claim 3, wherein a communicating passage is provided in said guide wall, said communicating passage connecting said space to said return passage.

5. An electric blower according to claim 3, wherein said communicating passage is inclined toward the downstream side in the direction of the air flow.

6. An electric blower according to claim 3, wherein a plurality of communicating passages are provided.

* * * * *